United States Patent [19]

Yahalom

[11] 4,284,482

[45] Aug. 18, 1981

[54] PALLADIUM TREATMENT PROCEDURE

[75] Inventor: Joseph Yahalom, Summit, N.J.

[73] Assignee: Bell Telephone Laboratories, Incorporated, Murray Hill, N.J.

[21] Appl. No.: 189,092

[22] Filed: Sep. 22, 1980

[51] Int. Cl.[3] ..... C25F 1/02

[52] U.S. Cl. ..... 204/140

[58] Field of Search ..... 204/140

[56] References Cited

U.S. PATENT DOCUMENTS

| | | | |
|---|---|---|---|
| 1,921,941 | 8/1933 | Powell et al. | 204/47 |
| 1,970,950 | 8/1934 | Wise | 204/1 |
| 1,981,715 | 11/1934 | Atkinson | 204/43 |
| 1,993,623 | 3/1935 | Raper | 204/1 |
| 2,452,308 | 10/1948 | Lombros | 204/47 |
| 3,150,065 | 9/1964 | Fatzer | 204/47 |
| 3,458,409 | 7/1969 | Hayashi et al. | 204/43 |
| 3,544,435 | 12/1970 | Angus et al. | 204/47 |
| 3,920,526 | 11/1975 | Caricchio et al. | 204/47 |

FOREIGN PATENT DOCUMENTS

| | | | |
|---|---|---|---|
| 1007174 | 10/1961 | United Kingdom | 204/140 |

*Primary Examiner*—R. L. Andrews

*Attorney, Agent, or Firm*—Walter G. Nilsen

[57] ABSTRACT

A process is described for treating palladium and palladium alloys so as to render them ductile and wear resistant. The process involves an electrochemical treatment which is relatively easy to carry out and is suitable for commerical use. Palladium surfaces and films treated with this process are quite suitable for a variety of applications including electrical contact applications as in switches, relays, connectors, etc.

16 Claims, 4 Drawing Figures

PALLADIUM TREATMENT PROCEDURE

TECHNICAL FIELD

The invention is a process for treating palladium films so as to render them ductile and wear resistant.

BACKGROUND OF THE INVENTION

Palladium and palladium alloys are extensively used in a variety of industrial applications including the fabrications of jewelry, optical devices and electronic circuits and devices. Palladium and its alloys are attractive because of chemical inertness, surface luster and high electrical conductivity as well as excellent surface property, particularly for electrical contacts. In many applications, chemical inertness is highly advantageous for long life and high reliability. This is particularly true for applications in electrical and electronic devices.

Because of chemical inertness and reasonable surface hardness, palladium is especially attractive as an electrical contact material in electrical connectors, switches, etc. Various palladium alloys such as palladium silver and palladium nickel are also useful for the same applications. Indeed, because of the increasing cost of gold, palladium becomes more attractive economically as a contact material and as a surface material. In many applications where gold is used, it is often economically attractive to use palladium provided an inexpensive and efficient method of plating ductile and wear resistant palladium is available.

Commercially attractive processes for applying palladium films require high plating rates. Such plating rates often lead to undesirable film properties. In many such processes the palladium film is found to be brittle and susceptible to cracking. When used in electrical contact applications, there is a high incidence of failure due generally to palladium film problems. Often palladium film properties can be improved by drastically reducing plating rates, but such a solution is economically unsatisfactory. It is highly desirable to develop a simple, reliable, rapid process for rendering brittle palladium films ductile so as to be of use in various applications, including electrical connectors.

Palladium plating processes have been described in a number of references, including U.S. Pat. No. 1,970,950, issued to E. M. Wise on Aug. 21, 1934; U.S. Pat. No. 1,993,623, issued to A. R. Raper on Mar. 2, 1935; U.S. Pat. No. 3,920,526, issued to J. J. Caricchio, Jr. et al on Nov. 18, 1975; U.S. Pat. No. 1,921,931, issued to A. R. Powell et al on Aug. 8, 1933; U.S. Pat. No. 3,544,435 issued to H. C. Angus on Dec. 1, 1970; U.S. Pat. No. 3,458,409, issued to S. Hayashi et al on July 29, 1969; U.S. Pat. No. 2,452,308, issue to G. C. Lambros on Oct. 26, 1948 and U.S. Pat. No. 3,150,065, issued to G. D. Fatzer on Sept. 22, 1964.

SUMMARY OF THE INVENTION

The invention is an electrochemical oxidation process for treating palladium surfaces and films as well as palladium alloy surfaces and films so as to make them ductile and wear resistant. The process involves making the palladium film of palladium alloy film part of the anode in an electrochemical process and exposing the palladium or palladium alloy film to a sufficiently positive electrode potential to oxidize hydrogen without oxidizing palladium. The exact electrode potential range that is permitted depends on the composition of the electrochemical electrolyte used in the electrochemical procedure. The minimum potential is the hydrogen electrode potential for the aqueous electrochemical electrolyte at one atmosphere hydrogen pressure. The maximum potential permitted depends on the composition of the bath but should be such as to avoid extensive oxidation of the palladium metal. Both solid palladium and films may be treated but the process is most useful for palladium films which have been electroplated onto a surface. Exposure times may vary from a few seconds to an hour. The higher the electrode potential the more rapid the process may be carried out. Films may vary in thickness from a tenth of a micron to 25 microns. In general, the thicker the film the more time required to carry out the process. Often the process is carried out in conjunction with electroplating palladium films from aqueous solution. The electrochemical oxidation may be carried out in the same solution as the palladium plating or in a separate solution. Palladium films treated in accordance with the invention are found to be ductile and resistant to wear and are quite suitable for use in a variety of applications, including as electrical contacts. Although this process is largely applicable to nominally pure palladium films, it may be used for various alloys of palladium provided the alloy contains at least 30 weight percent palladium. Examples are palladium alloys with silver, nickel and other noble metals. Generally, nominally pure palladium films have at least 98 weight percent palladium and often even higher (99.5) weight percent palladium.

DETAILED DESCRIPTION

1. Nomenclature

Figure 1:
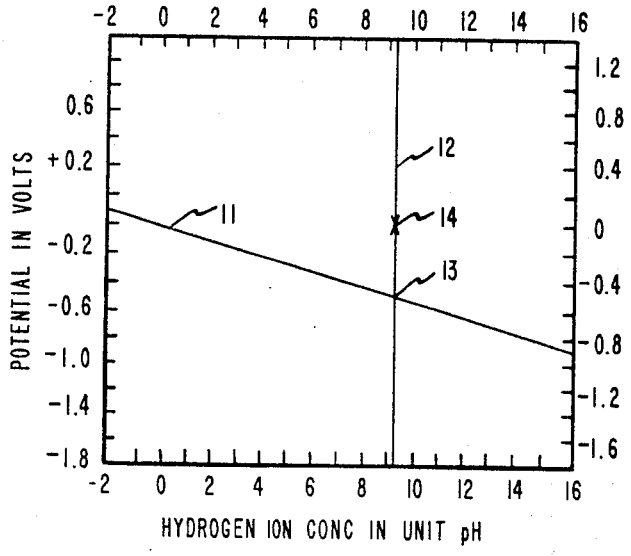
FIG. 1 shows a plot of hydrogen electrode potential versus hydrogen ion concentration for an equilibrium hydrogen pressure of one atmosphere.

In order to facilitate an understanding of the invention, the nomenclature of electrochemistry is reviewed. Metals and certain other substances in reversible equilibrium with cations they yield in aqueous solution, exhibit a voltage or electrode potential with respect to the solution potential. This electrode potential is characteristic of the electrode substance, as well as contents and concentration of the aqueous solution and other variables such as gas pressure (where a gas is involved in the electrode reaction), surface condition of the material, etc. Electrode potential is not directly measurable, only the difference in potential between two electrodes is observable.

A well-known electrode useful in a number of applications is the hydrogen electrode. The hydrogen electrode generally comprises an inert metal in contact with hydrogen gas and a solution of hydrogen ions. The inert metal is usually catalytic to the hydrogen electrode reaction, namely $\frac{1}{2}\ H_2 \rightleftarrows H^+ + e$, and almost always comprises platinum coated with platinum black. The electrode potential of the hydrogen electrode varies with hydrogen pressure and hydrogen-ion concentration. Standard conditions for the hydrogen electrode are defined as a hydrogen gas pressure of one atmosphere and a hydrogen-ion concentration of one gram equivalent per liter.

In order to formulate a scale of electrode potentials, the hydrogen electrode under standard conditions is taken as zero potential. This fixes an arbitrary scale for electrode potentials which is generally accepted in this field. This scale is called the Hydrogen Scale and is used throughout this disclosure. Electrode potentials for a large variety of materials are set forth in tables in a number of references including, for example, *Electrochemistry,* by C. W. Davies, Philosophical Library Inc., New York, 1968, Appendix 5; *Oxidation Potentials,* by W. M. Latimer, Prentice-Hall, Inc., Englewood Cliffs, N.J., 1956; and *The Handbook of Chemistry and Physics,* R. C. Weast, Editor, CRC Press, Inc., West Palm Beach, Fla., 1979.

Although the electrode potentials discussed in this application refer to the hydrogen electrode potential under standard conditions as the zero or standard potential, various secondary reference electrodes may be used for convenience. Typical secondary standards are the calomel electrode, the silver-silver chloride electrode, and the mercury-mercury sulfate electrode. Preferably, the calomel electrode is used because it is readily available, highly reproducible and easily used.

As stated above, the hydrogen electrode potential is taken as zero under standard conditions of hydrogen pressure and hydrogen-ion concentration (one atmosphere and one gram equivalent per liter). Variations from standard conditions will change the hydrogen electrode potential in accordance with the formula $$E = E_o + \frac{RT}{ZF} \ln \frac{[H^+]}{p^{\frac{1}{2}}} \quad (1)$$

where $E_o$ is the standard potential for the hydrogen electrode (taken as zero for the hydrogen electrode potential scale), R is the gas constant, T is the absolute temperature, Z is the number of gram equivalents involved in the electrode reaction, F is Faraday's number, $[H^+]$ is the hydrogen-ion activity (essentially equal to the concentration) and $P^{\frac{1}{2}}$ is the hydrogen gas pressure. For room temperature and one atmosphere hydrogen pressure, Equation 1 reduces to $$E = -0.059\text{pH}, \quad (2)$$

This relation is plotted in FIG. 1 and shows how the hydrogen electrode potential varies with hydrogen-ion concentration at one atmosphere hydrogen pressure.

In general, an electrochemical apparatus comprises two electrodes, a cathode electrode and an anode electrode. Chemical reduction takes place at the cathode and chemical oxidation takes place at the anode. In an electrolysis process carried out in an aqueous electrolyte, water is often reduced at the cathode with the liberation of hydrogen gas.

2. The Invention

The invention is an electrochemical oxidation process for palladium metal in which the palladium metal is immersed in an aqueous electrochemical solution and exposed to an electrode potential greater than the hydrogen electrode potential for the pH of the aqueous electrochemical solution but less than the electrode potential where extensive oxidation of palladium metal will take place. This maximum potential is the oxidation potential for palladium in the aqueous electrochemical solution plus about 20 percent of the difference between the above palladium oxidation potential and the above hydrogen electrode potential. The hydrogen electrode potential may be determined with the aid of FIG. 1 or either equation (1) or (2). The oxidation potential for palladium may be determined by experiment or from known oxidation potential for palladium metal in the electrolyte. The nature of the cathode is not critical. Carbon is convenient as are other inert substances such as nickel, stainless steel, platinum, etc. Generally, water is electrolyzed at the cathode with the liberation of hydrogen.

The pH of the aqueous electrochemical solution may vary over large limits, typically from 0–14 for convenience. Generally the pH is governed by the substrate, that is alkaline solutions are convenient when copper and nickel are the substrates because these materials are passivated in alkaline solution. A pH of 7–12 is often most convenient.

It is preferred to maintain the anode electrode potential at the maximum positive value without substantially exceeding the palladium oxidation potential for the electrochemical electrolyte. Minor momentary potentials that exceed the palladium oxidation potential are not disadvantageous but continuously exceeding this potential may oxidize palladium and probably will not substantially increase the speed of the process. The preferred anode electrode potential has a maximum value equal to the oxidation potential of palladium in the electrochemical solution being used and a minimum potential which is less than the above oxidation potential by about 20 percent of the difference between said oxidation potential and the hydrogen electrode potential for the pH of the electrochemical solution and one atmosphere hydrogen gas.

The anode potential for the anode oxidation process may be controlled in a variety of ways. For example, the voltage between anode electrode and cathode electrode could be measured with a voltmeter and the electrolytic current adjusted manually to ensure that the anode electrode is greater than the hydrogen electrode voltage for the electrolyte. Here, the anode electrode potential must be derived indirectly by subtracting out the potential drop from the cathode electrode and other sources.

Closer control of the anode potential is highly advantageous. It ensures maximum potential for maximum oxidation rate without exceeding the oxidation potential for palladium metal. Also, the potential difference between mode and cathode electrode is not a direct measure of the anode electrode potential. For example, it includes IR voltage drops in the electrochemical electrolyte and conductor leads, etc., and the potential drop between cathode and electrolyte. Close control of the anode electrode potential is highly desirable to maximize oxidation rate without dissolving palladium metal.

For the above reasons, it is preferred to use a third electrode (called a reference electrode) to monitor the anode electrode potential. The reference electrode may be a hydrogen electrode, but usually a secondary electrode is used (as, for example, the secondary electrodes mentioned above) and a correction used so the potential corresponds to the hydrogen scale. It is preferably located where plating current variations have a minimum effect of the measured anode electrode potential. Since very little current is drawn through the reference cell and the reference cell can be positioned (i.e., close to the working electrode) so as to minimize errors in the potential measurement, potential measurements are very accurate and the potential can be maintained very close to the desired palladium oxidation potential (to maximize oxidation rate) without excessively exceeding the palladium oxidation potential. Also, the reference electrode may be located at some distance from the working electrode and a correction made for the resulting voltage drop in the solution.

The process can be controlled in a variety of ways. A constant voltage can be applied across the electrodes such that the anode potential on the hydrogen scale is close to but not in excess of the oxidation potential of palladium on the hydrogen scale. Generally, under these constant voltage conditions, the current decays as the hydrogen trapped in the palladium is oxidized.

A particularly preferred method of controlling the electrode potential is by use of a potentiostat. The potentiostat is a controller circuit which maintains the potential between anode electrode and reference electrode equal to some desired potential (here, a potential more positive than the hydrogen electrode potential for one atmosphere hydrogen pressure and the pH of the electrochemical solution but not greater than the oxidation potential for palladium). It maintains this potential by varying the current going through the anode electrode and cathode electrode. Such automatic control of the anode electrode potential allows closer approach to the oxidation potential of palladium without exceeding this potential. Thus, the rate of anodic oxidation is maximized without dissolving the palladium. Generally, it is most convenient to have an anode electrode potential within plus or minus 10 or 20 percent of the oxidation potential for palladium. The 10 or 20 percent refers to a percentage of the difference in electrode potential between the oxidation potential for palladium and the hydrogen potential for one atmosphere pressure and the pH of the electrochemical solution. Exceeding the oxidation potential is not harmful except that it dissolves palladium or forms oxidized surface films on it and does not materially increase the anodic oxidation rate. Thus, it is preferred that the anode potential be between the oxidation potential for palladium (in the particular electrochemical electrolyte) and 10 or 20 percent less than this potential.

Various types of potentiostats may be used. Some types of potentiostats are described in a number of references, including: *Experimental Electrochemistry for Chemists* by D. T. Sawyer and J. L. Roberts, Jr., John Wiley and Sons, New York pp. 256–269; W. M. Schwartz and I. Shain, *Anal. Chem.* 35, 1770 (1963); and the instruction manual for *Polarographic Analyzer Model* 174, Princeton Applied Research Corporation, Princeton, N.J., 1971. Another useful reference is "Operational Amplifiers Instruments for Electrochemistry" in *Electrochemistry,* Vol. 2 of *Computers in Chemistry and Instrumentation,* J. S. Mattson, H. B. Mark, Jr., and H. C. MacDonald, Jr., eds., Marcel Dekker, Inc., New York, 1972 Chapter 10.

Alternatively, the process may be controlled galvanostatically (constant current) and the voltage between anode electrode and reference electrode monitored and not allowed to exceed the limits set forth above.

3. Typical Operation

Generally, the anionic oxidation procedure is carried out on palladium film that is electroplated on a surface. The anodic oxidation may be carried out in the same solution as the plating or in a different solution.

A large variety of procedures may be used to electroplate the palladium metal. Indeed, one of the advantages of the inventive procedure is that greater leeway is available for producing the electroplated palladium. For example, the working electrode potential may be much lower (i.e., more negative than the hydrogen electrode potential for the plating solution and one atmosphere hydrogen pressure) so that hydrogen is liberated during the plating process. This is advantageous because it permits much higher plating rates which is economically advantageous. Also, control of the plating voltage (the working electrode potential) is not necessary which permits greater flexibility in commercial operation.

It is preferred to avoid formation of the $\beta$-phase of palladium hydride. This can be done by limiting the amount of hydrogen absorbed into the palladium metal to less than about two mole percent. Although large variations in the working electrode potential are permissible, it is preferred that the average potential over the palladium plating process be less than 0.2 volts below the hydrogen electrode potential for one atmosphere hydrogen pressure at the pH of the solution. For pH=9.0, the working electrode potential should not be more negative than −0.73 volts.

A large variety of plating solutions may be used. Typical are ammonia-based plating solutions, but other types of palladium plating solutions are also useful. Typical plating solutions with preferred concentration ranges are given below. Also given is the pH of the aqueous solution and hydrogen electrode potential (in volts) for one atmosphere hydrogen pressure and the pH of the solution taken from FIG. 1 (the curve marked 11) or equation (1) or (2).

EXAMPLE 1

| |
|---|
| $Pd(NH_3)_4Cl_2$ |
| $NH_4Cl$ |
| sufficient ammonia to pH 9–10, 9.4 preferred |
| E(hydrogen electrode potential) |
| = −0.531 for ph = 9.0; |
| −0.590 for pH = 10.0 and |
| −0.555 for pH = 9.4 |

EXAMPLE 2

| | |
|---|---|
| $Pd(NH_3)_2(NO_2)_2$ | 4g palladium/l |
| $NH_4NO_3$ (optional) | 90 g/l |
| $NaNO_2$ (optional) | 11.3 g/l |
| Ammonia to pH between 8 and 10, 9.0 preferred. | |
| E = −0.531 for pH = 9.0. | |

In many applications, a higher concentration of palladium salt, even a saturated solution is preferred.

EXAMPLE 3

$Pd(NH_3)_4(NO_3)_2$

Salts to stabilize the complex and increase conductivity.

pH=7–10 by addition of alkaline agent such as ammonia.

E=−0.413 for pH=7; −0.590 for pH=10.

EXAMPLE 4

| | |
|---|---|
| $Pd(NH_3)_2Cl_2$ | 10 g/l to saturation |
| $NH_4Cl$ | 65 to 250 g/l |
| pH adjusted by the addition of ammonia to 8.0–12.0; 8.8 to 9.2 preferred. | |

Generally, for the described process, a high concentration of the palladium salt is preferred with or without the conducting salts, provided such a bath is stable.

Other palladium complexes are also useful as plating baths in the practice of the invention. The palladium complex $Pd(NH_3)_4Br_2$ is used as the basis for some palladium plating baths. Useful concentrations in terms of palladium metal are from 2 g/l to saturation (about 35 g/l). The pH range is from 9 to 10 with the range from 9 to 9.5 preferred. Other palladium complexes such as the corresponding sulfate, phosphate, tartrate, citrate, oxalate and carbonate also may be useful.

The double nitrite salts of palladium are also useful for palladium plating. A typical salt is $K_2Pd(NO_2)_4.2H_2O$. Other similar salts (i.e., potassium replaced by another alkali metal such as sodium, lithium, etc.) may also be used.

Another typical palladium bath contains a palladium solution complexed with ethylene diamine or other complexing agent. Typically, the palladium is added as $PdCl_2$ and sulfate as an alkali-metal sulfate ($Na_2SO_4$). Sufficient complexing agent (i.e., ethylene diamine) is added to dissolve the palladium chloride. Typical concentrations are 28 g/l $PdCl_2$ and 140 g/l $Na_2SO_4$. Increased concentration of palladium compound is desirable up to the saturation concentration of the palladium complex. The pH may vary over certain limits (i.e., 10–13) but is usually between 11 and 12. For a pH of 11, E equals −0.649; for a pH of 12 it is −0.708.

The simple salt $PdCl_2$ is also used in plating baths in the practice of the invention. Typically, the bath comprises $PdCl_2$, ammonium chloride and a strong acid (generally aqueous HCl) to a pH from 0.1 to 0.5. Typical concentration of $PdCl_2$ is 52 g/l to saturation and 22–38 g/l $NH_4Cl$. Plating temperature may vary over large limits but room temperature to 50 degrees C is usually used. For a pH of 0.1, the maximum negative potential is −6 millivolts; for a pH of 0.5, the maximum negative potential is −30 millivolts.

The preferred plating bath contains $Pd(NH_3)_4\ Cl_2$ as the source of palladium. Amounts of at least 10 g/l (in terms of palladium metal) are preferred with various salts such as $NH_4Cl$ added to yield a pH between 9 and 10, preferably 9.4. Higher concentrations of $Pd(NH_3)_4Cl_2$ are more preferred, say greater than 20 g/l or even 100 g/l. Increased concentrations of the palladium complex reduces the amount of conducting salts (i.e., $NH_4Cl$) that can be dissolved in the bath.

Preparation of the plating baths may be accomplished in a variety of ways, including direct addition of the palladium salt (e.g., $Pd(NH_3)_4Cl_2$) or addition of substances that yield the palladium species on chemical reaction. For example, the palladium complex $Pd(NH_3)_4CL_2$ may be obtained by the addition of $PdCl_2$ to boiling ammonia water. Plating solutions and palladium plating are discussed in a book by E. M. Wise entitled *Palladium; Recovery, Properties and Uses,* Academic Press, New York, 1968, especially chapter 6.

After plating, the palladium metal may be treated either in the plating bath or a different electrolytic solution. The procedure is illustrated using a plating bath comprising a saturated solution of $Pd(NH_3)_4Cl_2$ and a pH of 9.4. This pH corresponds to the vertical line 12 in FIG. 1. The hydrogen electrode potential 13 for this pH and one atmosphere hydrogen pressure is −0.555. It is preferred that the plating occur at a working potential greater (more positive) than the sum of the hydrogen electrode potential and the −0.20 volts set forth above to avoid extensive formation of the $\beta$-phase of palladium hydride; that is greater than −0.755 volts.

In order to achieve anodic oxidation, the current is reversed so that the working electrode becomes the anode in the electrolytic process. The process is carried out by exposing the palladium metal to an anode electrode potential between the hydrogen electrode potential 13 (see FIG. 1) for one atmosphere hydrogen pressure and pH=9.4 (−0.555) and the oxidation potential 14 of palladium (0.00) plus 20 percent of the difference between these potentials ($0.2\times0.555=0.111$). It is preferred that the anode electrode potential be within the oxidation potential for palladium and a potential which is 20 percent (of the difference between the hydrogen potential and the palladium oxidation potential) less than the palladium oxidation potential. For this solution, this preferred potential is from 0.00 volts and −0.111 volts. Within 10 percent (0.00 to −0.056 volts) is even more preferred.

In symbols, the anodic electrode potential ($E_A$) should be between the hydrogen electrode potential (E) for one atmosphere hydrogen pressure and the pH of the solution and a potential given by $E_p+0.2(E_p-E)$, where $E_p$ is the oxidation potential for palladium metal. The preferred range is $E_p \geqq E_A \geqq E_p-0.2(E_p-E)$.

The oxidation potential for palladium may be determined theoretically or experimentally. It can be observed experimentally by increasing the palladium electrode potential (on the hydrogen scale) and measuring the current. The current will begin negative (corresponding to reduction), cross zero and become positive (corresponding to oxidation). The potential where the current becomes zero is the oxidation potential for palladium.

In some situations, it might be more convenient to carry out the anodic oxidation in an electrochemical electrolyte different from the plating solution. The anodic oxidation may be carried out immediately after the plating procedure (as in a strip line plating apparatus) or at some later time on a completely separate apparatus. Use of a separate solution has a certain advantages. For example, a higher anode electrode potential can be used since the solution composition can be different from the plating bath composition. Typically the solution for anodic oxidation would not contain complexing ions for palladium. Also, the use of large anode electrode potential does not lead to dissolution of palladium but rather the formation of a film of oxidized palladium such as palladium oxide.

Again, the limits for the anode potential are the same as above (except that now the oxidation potential for palladium is greater). The minimum potential is the hydrogen electrode potential for an atmosphere hydrogen pressure and the pH of the electrochemical electrolyte. The maximum anode potential is the oxidation potential of palladium plus twenty percent of the difference in the two above potentials. The preferred range is from 20 percent (of the difference in the two potentials)

below the oxidation potential of palladium to the oxidation potential of palladium.

The standard oxidation potential of palladium may be measured as described above. For electrochemical electrolytes without substances that form soluble complexes or insoluble salts with palladium, the oxidation potential of palladium as a function of pH has been determined. This relationship is plotted in FIG. 2. As can be seen, the oxidation potential of palladium decreases with increasing pH. Analytically, the oxidation potential of palladium is given by $$E_p = 0.917 - 0.0591\text{pH}.$$

The electrochemical electrolyte might be pure water, water with conductivity salts or water with a buffer. A buffered solution is preferred since it stabilizes the pH and thereby stabilizes the oxidation potential of palladium. Substances that form soluble complexes with palladium or insoluble salts should be avoided.

Various buffer systems may be used depending on the desired pH and compatibility with the palladium anodic oxidation procedure. Typical buffer solutions are listed in standard reference books *Handbook and Chemistry and Physics, Langes Handbook of Chemistry,* etc.). Typical aqueous buffer solutions are potassium hydrogen tartrate, potassium hydrogen phthalate, equal amounts of $KH_2PO_4$ and $Na_2HPO_4$ (generally in the range of 0.025 M) and equal amounts of $NaHCO_3$ and $Na_2CO_3$. Generally, the concentration range is from 0.01 to 0.05 M with 0.025 M preferred. This yields a pH of about 10. Pure aqueous $NaHCO_3$ has a pH of about 8.5 and pH can be increased by the addition of a base (NaOH, KOH, etc.), or $Na_2CO_3$.

For pH=9, the oxidation potential for Pd is 0.917−0.532=0.385 volts and the hydrogen electrode potential is −0.532. The anode electrode should be between a maximum value of 0.385+0.2(0.385+0.532) or 0.568 volts and a minimum value of −0.532. The preferred range is from 0.385−0.2(0.385+0.532) or 0.202 volts and 0.385 volts.

4. The Figures

FIG. 1 has been described in detail in the above sections.

Figure 2:
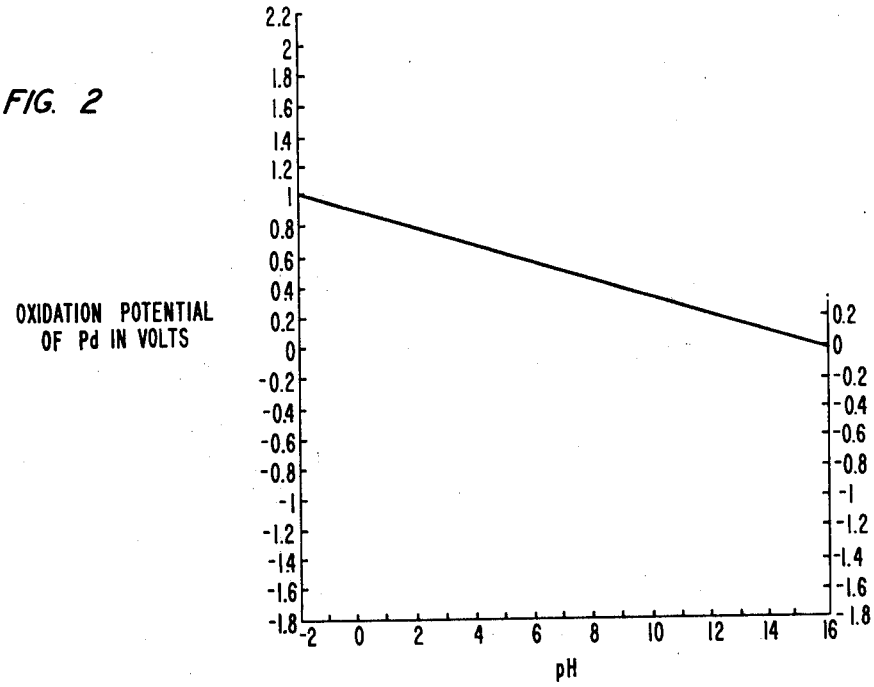
FIG. 2 shows a plot of palladium oxidation potential vs. pH of the electrochemical solution for a solution of one gram equivalent of palladium ion per liter.

FIG. 2 has been described in detail in the above sections.

Figure 3:
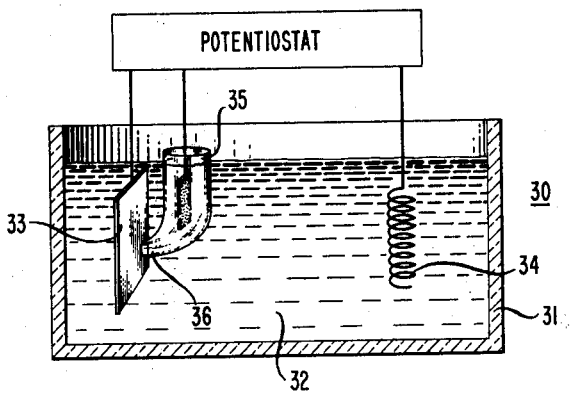
FIG. 3 shows a typical electrochemical apparatus for carrying out the electrochemical oxidation on palladium.

FIG. 3 shows a typical apparatus 30 to carry out an anodic oxidation procedure. The apparatus comprises container 31 with electrochemical electrolyte 32, anode electrode 33 and cathode electrode. The anode and cathode electrodes are powered from a source of electrical energy, usually a potentiostate. Electrical conductors 35, 36 connect anode and cathode to the potentiostat. A reference electrode 35 (usually a calomel cell) is often used to control the anode electrode potential. A small capillary 36 is located close to the anode to reduce voltage sources other than the electrode potential for anode and reference electrode.

Figure 4:
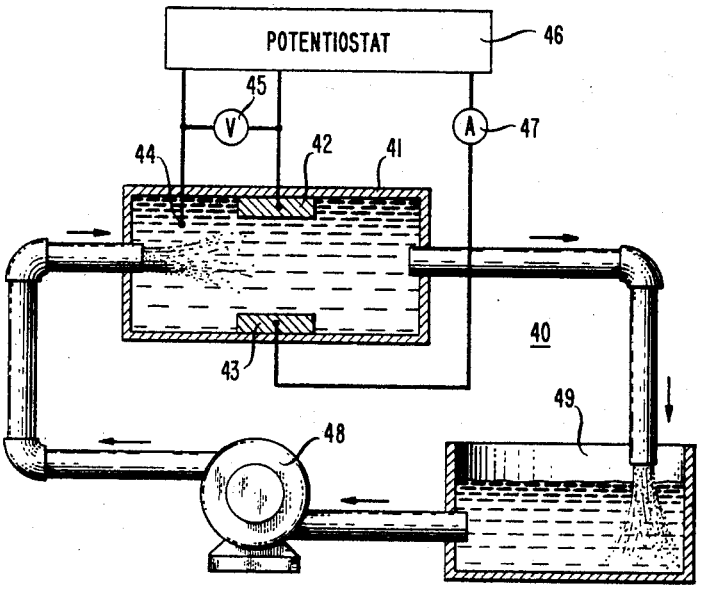
FIG. 4 shows an electroplating apparatus useful in electroplating palladium.

FIG. 4 is a schematic view of a typical plating apparatus 40, showing plating cell 41 with working electrode 42 and counter electrode 43. Also shown is the reference electrode 44 together with a voltmeter 45 for monitoring the plating potential and the potentiostat 46. The potentiostat supplies sufficient current as measured by the ammeter 47 to maximize plating current without exceeding a predetermined plating potential. Plating solution is pumped into the plating cell 41 by means of a liquid pump 48. A reservoir 49 receives bath solution coming out of the plating cell. Agitation of the plating solution may be accomplished by increasing the flow rate through the plating cell or by a separate stirrer or by forcing the solution through a jet towards the working electrode.

What is claimed is:

1. A process for making palladium surface and films ductile involving electrochemical oxidation in an aqueous electrochemical solution comprising the step of passing current through a cathode, said aqueous electrochemical solution and an anode characterized in that the palladium film comprises the anode and the anode is maintained at an anode electrode potential greater than the hydrogen electrode potential for one atmosphere pressure of hydrogen and the hydrogen-ion concentration of the aqueous electrochemical solution but less than the electrode potential determined by adding together first, the oxidation potential of palladium metal in the aqueous electrochemical solution and second, 20 percent of the difference between said oxidation potential of palladium and said hydrogen electrode potential.

2. The process of claim 1 in which the anode electrode potential has a maximum value equal to the oxidation potential of palladium metal in the aqueous electrochemical solution and a minimum value which is said oxidation potential less 20 percent of the difference between said oxidation potential and the hydrogen electrode potential at the pH of the aqueous electrochemical solution and one atmosphere hydrogen pressure.

3. The process of claim 2 in which the anode electrode potential is controlled by reference to a reference electrode.

4. The process of claim 3 in which a potentiostat is used to control anode electrode potential relative to a reference electrode.

5. The process of claim 4 in which the reference cell is a calomel cell.

6. The process of claim 1 in which the palladium is produced by an electroplating procedure.

7. The process of claim 6 in which the anodic oxidation takes place in a palladium electroplating bath.

8. The process of claim 7 in which the palladium electroplating bath is an ammoniacal solution with an amine palladium complexion.

9. The process of claim 8 in which the palladium amine complex is selected from the group consisting of $Pd(NH_3)_4Cl_2$, $Pd(NH_3)_2(NO_2)_2$, $Pd(NH_3)_4(NO_3)_2$, $Pd(NH_3)_2Cl_2$ and $(NH_3)_4Br_2$.

10. The process of claim 9 in which the bath contains $Pd(NH_3)_4Cl_2$ with concentration in terms of palladium metal of at least 10 g/l.

11. The process of claim 10 in which the concentration is at least 20 g/l.

12. The process of claim 11 in which the concentration is at least 100 g/l.

13. The process of claim 1 in which the anodic oxidation is carried out in an aqueous electrochemical solution different from the palladium plating solution.

14. The process of claim 13 in which the aqueous electrochemical solution comprises a buffer.

15. The process of claim 14 in which the buffer is selected from the group consisting of potassium hydrogen tartrate, potassium hydrogen phthalate, $KH_2PO_4$ and $Na_2HOP_4$.

16. The process of claim 13 in which the buffer comprises $NaHCO_3$ and $Na_2CO_3$ and the pH is between 8.5 and 10.

* * * * *